US008215931B2

(12) United States Patent
McDowell et al.

(10) Patent No.: US 8,215,931 B2
(45) Date of Patent: Jul. 10, 2012

(54) SAFETY SWITCH ON A PERISTALTIC PUMP

(75) Inventors: William M. McDowell, Garden Grove, CA (US); John Nguyen, Yorba Linda, CA (US); Robert E Gledhill, Huntington Beach, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 608 days.

(21) Appl. No.: 12/400,639

(22) Filed: Mar. 9, 2009

(65) Prior Publication Data

US 2010/0008793 A1 Jan. 14, 2010

Related U.S. Application Data

(60) Provisional application No. 61/080,642, filed on Jul. 14, 2008.

(51) Int. Cl.
*F04B 43/08* (2006.01)

(52) U.S. Cl. ..... 417/477.1; 417/33

(58) Field of Classification Search ..... 417/477.1, 417/33, 44.1, 63

See application file for complete search history.

(56) References Cited

U.S. PATENT DOCUMENTS

| | | | | |
|---|---|---|---|---|
| 2,123,781 | A | 7/1938 | Huber | |
| 4,231,725 | A | 11/1980 | Hogan | |
| 4,341,002 | A | 7/1982 | Diba | |
| 4,518,327 | A | 5/1985 | Hackman | |
| 4,527,323 | A | 7/1985 | Dawson | |
| 4,558,996 | A * | 12/1985 | Becker | 417/374 |
| 4,673,334 | A | 6/1987 | Allington et al. | |
| 4,925,376 | A | 5/1990 | Kahler | |
| 5,190,448 | A | 3/1993 | Lane et al. | |
| 5,201,711 | A | 4/1993 | Pasqualucci et al. | |
| 5,267,956 | A | 12/1993 | Beuchat | |
| 5,370,510 | A | 12/1994 | Sinclair et al. | |
| 5,375,309 | A | 12/1994 | Dunn | |
| 5,387,088 | A | 2/1995 | Knapp et al. | |
| 5,388,972 | A | 2/1995 | Calhoun et al. | |
| 5,484,239 | A | 1/1996 | Chapman et al. | |
| 5,588,815 | A | 12/1996 | Zaleski, II | |
| 5,871,341 | A | 2/1999 | Melody | |
| 5,915,932 | A | 6/1999 | Nabity et al. | |
| 6,203,295 | B1 | 3/2001 | Nishioka | |
| 6,213,739 | B1 | 4/2001 | Phallen et al. | |
| 6,523,862 | B1 | 2/2003 | MacDuff | |
| 6,658,711 | B1 | 12/2003 | Benson | |
| 6,695,807 | B2 | 2/2004 | Bell et al. | |
| 6,731,216 | B2 | 5/2004 | Ho et al. | |
| 7,275,293 | B2 | 10/2007 | Wathey | |
| 7,300,264 | B2 | 11/2007 | Souza | |
| 7,347,457 | B2 | 3/2008 | Wulf et al. | |
| 7,434,312 | B2 | 10/2008 | Christenson et al. | |
| 2004/0179907 | A1 | 9/2004 | MacDuff | |
| 2005/0085699 | A1 | 4/2005 | Weiss | |
| 2007/0140880 | A1 | 6/2007 | Fulmer | |
| 2008/0101969 | A1 | 5/2008 | Moubayet | |
| 2009/0053084 | A1 * | 2/2009 | Klein | 417/477.1 |

* cited by examiner

*Primary Examiner* — Toan Ton
*Assistant Examiner* — Andrew Coughlin
(74) *Attorney, Agent, or Firm* — Knobbe, Martens, Olson & Bear LLP

(57) ABSTRACT

A peristaltic pump is provided that is configured to facilitate safe maintenance of the pump. The pump can comprise a pump body having a pump head and a head cover and a safety switch mechanism. The safety switch mechanism can comprise one or more sensors that allow the pump to detect whether the head cover is in an open or closed position. When the pump is powered-on, the pump can be configured to enter a maintenance mode when the safety switch detects that the head cover is in the open position.

21 Claims, 2 Drawing Sheets

SAFETY SWITCH ON A PERISTALTIC PUMP

CROSS-REFERENCE TO RELATED APPLICATIONS

This application claims the benefit of U.S. Provisional Application No. 61/080,642, filed Jul. 14, 2008, the entirety of the disclosure of which is incorporated herein by reference.

BACKGROUND

1. Field of the Inventions

The present inventions relate generally to peristaltic pumps. More particularly, the present inventions relate to a uniquely-configured peristaltic pump that can include a maintenance mode for facilitating safe replacement of pump tubing.

2. Description of the Related Art

A peristaltic roller pump typically has three or more rollers, but may have other configurations. The rollers are spaced circumferentially evenly apart and are mounted on a rotating carrier that moves the rollers in a circle. A length of flexible tubing is placed between the rollers and a semi-circular wall. In medical applications, the tubing can be a relatively soft and pliable rubber tubing. For relatively high pressure industrial applications, however, the tubing can be exceedingly durable and rigid, albeit flexible under the high pressure of the rollers.

In use, the rollers rotate in a circular movement and compress the tubing against the wall, squeezing the fluid through the tubing ahead of the rollers. The rollers are configured to almost completely occlude the tubing, and operate essentially as a positive displacement pump, each passage of a roller through the semicircle pumps the entire volume of the fluid contained in the tubing segment between the rollers.

As a positive displacement pump, relatively high positive pressures (e.g., 125 psi) can be generated at the pump outlet. Peristaltic roller pumps are typically driven by a constant speed motor that draws fluid at a substantially constant rate. Over time, the high pressures at the pump outlet can wear on the tubing and result in the development of small pinholes in the tubing. If unnoticed, the pinholes can grow and eventually result in failure of the tubing.

Ruptured tubing can lead to internal leakage and the cessation of proper function. When the pump is used to move a corrosive chemical, such as chlorine, internal leakage can be particularly hazardous. As the chemical comes into contact with the pump components, the pump may become irreparably damaged. This is a serious shortcoming because the costs associated with replacement of the pump can be very substantial.

When tubing is replaced, the placement of the tubing underneath the rollers of the pump can be a very difficult task, especially in industrial applications. Typically, a user will attempt to replace the tubing by connecting one end of the tubing to one of the inlet or outlet ends of the pump and then forcibly bending the tubing around the rollers of the pump. This task is extremely difficult considering the narrow spacing between the rollers and the pump wall.

SUMMARY

In accordance with another aspect of at least one of the embodiments disclosed herein is the realization that replacing tubing is facilitated if the rollers of a pump rotor are in motion. However, due to the usually high operating rpm of the rotor, the replacement of the tubing while the rotor is turning can be dangerous. Therefore, in some embodiments disclosed herein, a unique safety switch feature is provided that can be incorporated into the pump such that when a cover or panel of the pump is removed in order to replace the tubing, the pump is desirably permitted to operate only in a reduced rpm mode. In this manner, a user can benefit from a slow-moving rotor to facilitate replacement of the tubing without the danger of a fast-moving rotor.

In accordance with another embodiment, a safety switch is provided for a peristaltic pump. The switch can comprise first and second sensor components. The first sensor component can be attached to a head cover of the peristaltic pump. The first sensor component can be selectively moveable from a proximate position wherein the first sensor component is positioned adjacent to the peristaltic pump to a distal position wherein the first sensor component is positioned distally from the peristaltic pump in response to movement of the head cover thereof. Further, the second sensor component can be mounted on the peristaltic pump and can be configured to detect the presence of the first sensor component. The second sensor component can be in electrical communication with the peristaltic pump for determining an operational setting of the peristaltic pump. In this regard, the operational setting can be modified from a full-on mode with the first sensor component being in the proximate position to a maintenance mode with the first sensor component being in the distal position.

In another embodiment, a peristaltic pump is provided that can comprise a pump body, a rotor, and a sensor. The pump body can comprise a pump head and a head cover extending across an opening in the pump head. The head cover can have an open position and a closed position. The rotor can be disposed within the pump head. The sensor can be disposed on the pump head. The sensor can be operative to detect whether the head cover is in the open or closed position. In this regard, when the pump is powered-on, the pump can enter a maintenance mode when the sensor detects that the head cover is in the open position.

In some implementations, the sensor can be attached to the head cover of the pump. Further, the sensor can be aligned with a detection component attached to the pump head when the head cover is in the closed position. The sensor can be a magnet. For example, the sensor is a magnet disposed on the head cover.

Other implementations can be configured such that the head cover is removed from the pump in the open position. Further, the rotational speed of the rotor can decrease when the pump is powered-on and the head cover is in the open position. For example, the rotational speed can decrease to less than 20 rpm. The rotational speed can also decrease to less than 10 rpm. For example, the rotational speed can decrease to within a range of between approximately 10-20 rpm, between approximately 3-10 rpm, or between approximately 2-6 rpm. Furthermore, the rotational speed can decrease to 6 rpm.

It is contemplated that the maintenance mode of the pump can facilitate replacement of a tubing assembly disposed within the pump head. In some embodiments, when the pump is powered-on, the pump can operate in a normal mode when the head cover is in the closed position.

In another embodiment, a peristaltic pump is provided for facilitating safe maintenance of the pump. The pump can comprise a pump body and a safety switch mechanism. The pump body can comprise a pump head and a head cover extending across an opening in the pump head. The head cover can have an open position in which the head cover is removed and a closed position in which the head cover is mounted onto the pump head. The safety switch mechanism can be operative to detect whether the head cover is in the open or closed position. The safety switch mechanism can comprise a first sensor component and a second sensor component. The first sensor component can be disposed on the head cover. The second sensor component can be disposed on the pump head. In this regard, the second sensor component can be operative to detect the presence of the first sensor component when the head cover is in the closed position and to detect the absence of the first sensor when the head cover is in the open position. Further, when the pump is powered-on, the pump can enter a maintenance mode when the head cover is in the open position.

In some embodiments, the first sensor component can comprise a magnet. Further, the first sensor component can comprise a magnet disposed on the head cover. Additionally, the first sensor component can be aligned with the second sensor component when the head cover is in the closed position.

In other embodiments, the rotational speed of the rotor can decrease when the pump is powered-on and the head cover is in the open position. For example, the rotational speed can decrease to less than 20 rpm. The rotational speed can also decrease to less than 10 rpm. Furthermore, the rotational speed can decrease to 6 rpm.

In accordance with another embodiment, a peristaltic pump is provided for facilitating safe maintenance of the pump. The pump can comprise a pump head, a rotor disposed in an opening of the pump head, and a head cover that is mountable onto the pump head to extend across the opening in the pump head to cover the rotor. In this regard, when the pump is powered-on, the rotor rotates at an operational speed when the head cover is on the pump head and rotates at a slower speed when the head cover is off the pump head.

In some implementations, the pump can further comprise a safety switch mechanism for detecting when the head cover is mounted on the pump head. The safety switch mechanism can comprise a first sensor component and a second sensor component. The first sensor component can be disposed on the head cover. The second sensor component can be disposed on the pump head. The second sensor component can be operative to detect the presence of the first sensor component when the head cover is in the closed position and to detect the absence of the first sensor when the head cover is in the open position. Further, at least one of the first and second sensor components can be magnetic.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENTS

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Moreover, although not discussed at length herein, related embodiments of a tubing installation tool are disclosed in applicant's copending patent application, U.S. patent application Ser. No. 12/421,578, filed on Apr. 9, 2009, entitled TUBING INSTALLATION TOOL FOR A PERISTALTIC PUMP AND METHODS OF USE, the entirety of the disclosure of which is incorporated herein by reference. Further, related embodiments of a method for extending tubing life of a tubing assembly of a peristaltic pump are disclosed in applicant's copending patent application, U.S. patent application Ser. No. 12/400,637, filed on Mar. 9, 2009, titled METHOD OF EXTENDING TUBING LIFE OF A PERISTALTIC PUMP, the entirety of the disclosure of which is incorporated herein by reference.

Figure 1:
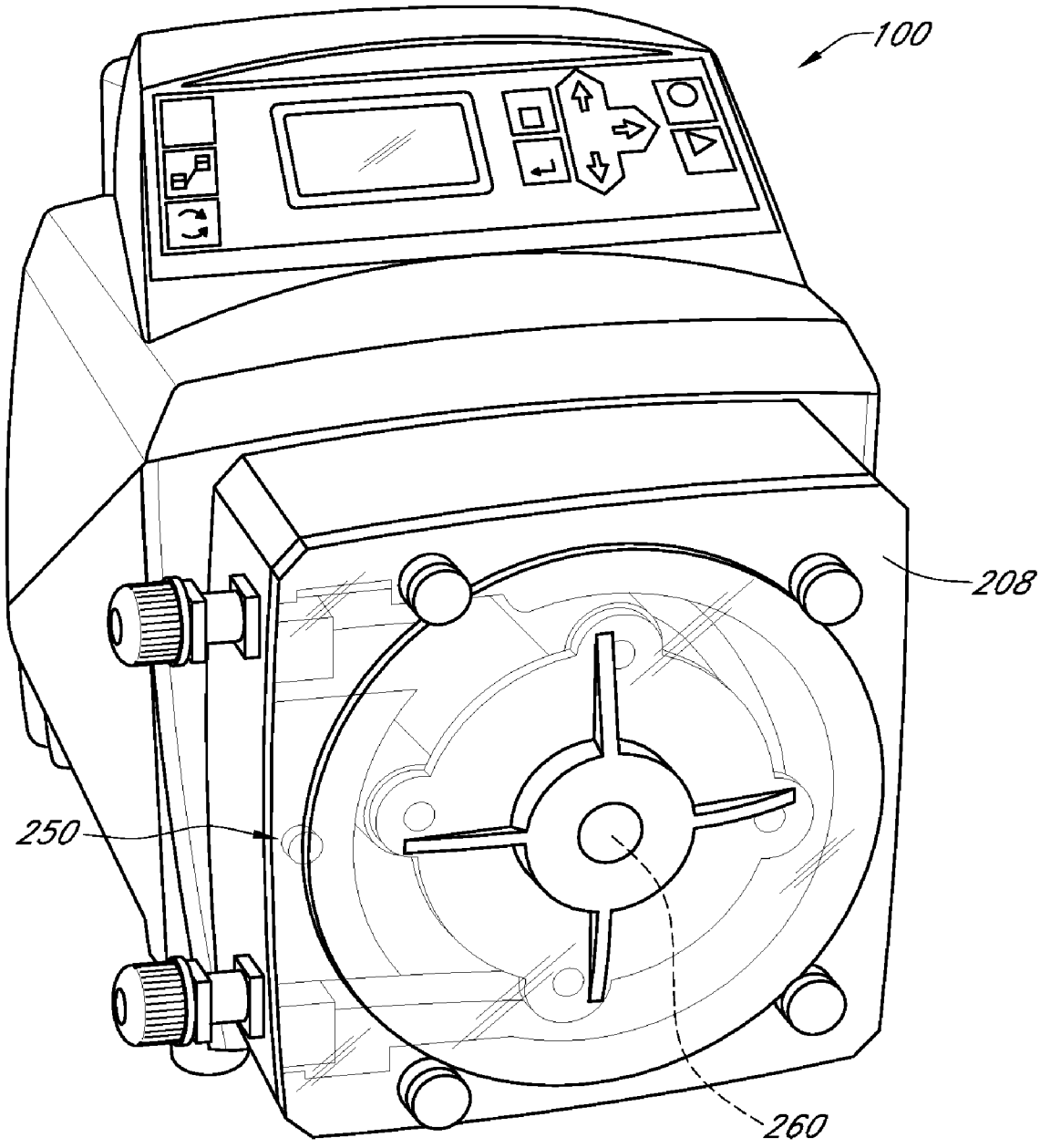
FIG. 1 is a perspective view of a peristaltic pump, according to an embodiment of the present inventions.
Figure 2:
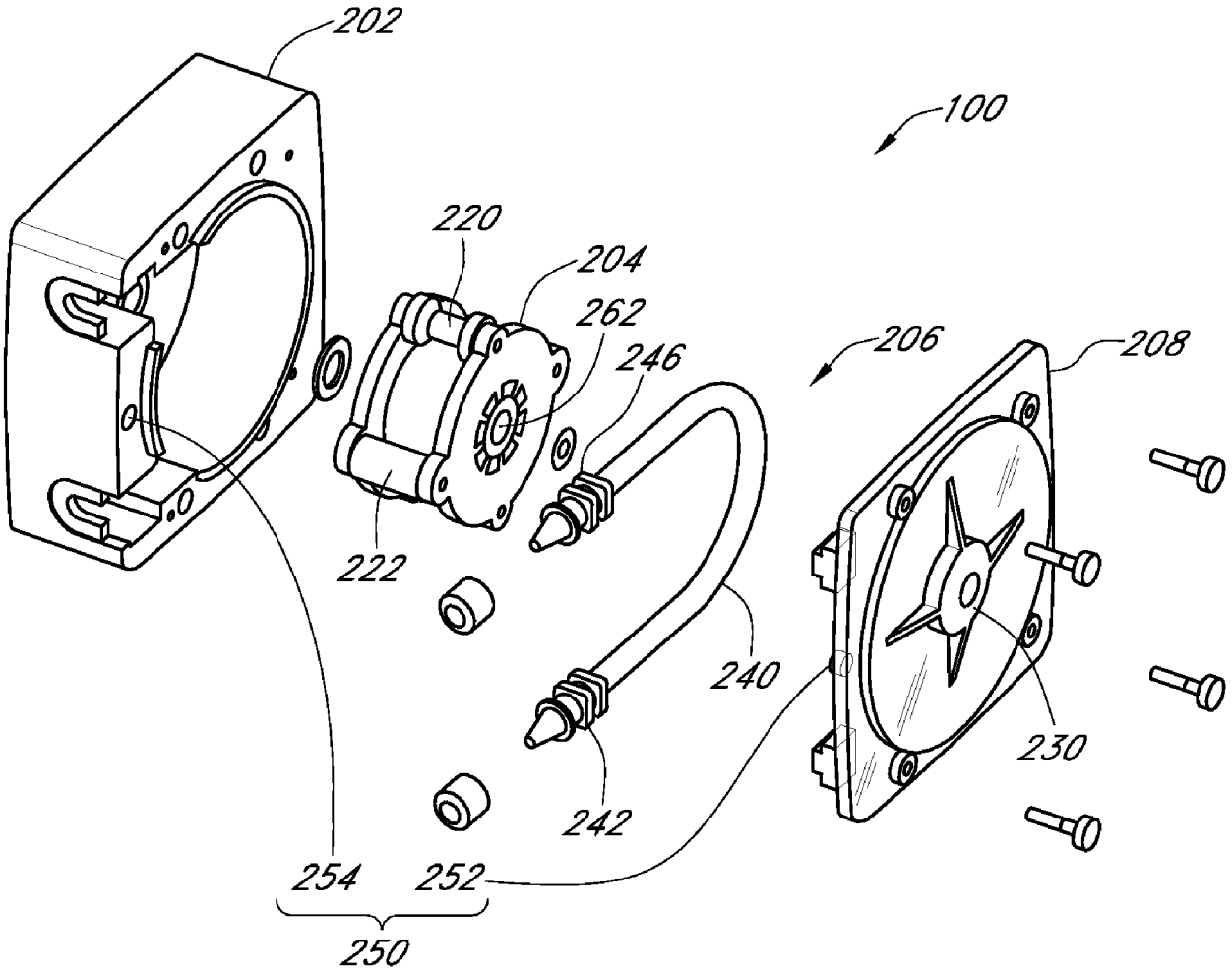
FIG. 2 is an exploded perspective view of components of a peristaltic pump, in accordance with an embodiment.

FIG. 1 is a perspective view of a peristaltic pump 100, according to an embodiment of the present inventions, and FIG. 2 is an exploded perspective view of components of a peristaltic pump, in accordance with an embodiment. As illustrated, the peristaltic pump can comprise a pump housing or head 202, a rotor 204 that rotates within a cavity of the pump head, a tube or tubing assembly 206, and a pump head cover 208 that encloses the rotor 204 and the tubing assembly 206 within the cavity of the pump head 202. The pump housing or head 202 can be formed such that the tubing assembly 206 is positioned in a loop. However, in some embodiments, the pump housing or head 202 can be formed such that the tubing assembly 206 passes in a straight line through the pump housing or head 202. In other words, the pump housing or head 202 can be configured such that the inlet or outlet ports formed therein provide for a loop or straight-line arrangement of the tubing assembly 206 when installed therein.

The tubing assembly 206 can comprise a tube 240 having connectors 242, 244 that are disposed at the opposing ends of the tube 240. It is contemplated that the connectors 242, 244 may be modified and even omitted in some embodiments. The rotor 204 can comprise a plurality of rollers that compress a tube of the tubing assembly within the pump head in order to force fluid through the tube. The rotor can rotate in a clockwise or counterclockwise direction. As will be appreciated, fluid in the tube can be urged within the tube along the direction of travel of the rollers.

As shown in FIG. 2, the rollers can comprise at least one alignment roller 220 and at least one compression roller 222. The alignment roller 220 can be formed to comprise a smaller diameter in a central portion thereof and a larger diameter along sides of the roller 220. In this manner, the roller 220 can be configured to maintain the tube within a gap between the rollers and a wall of the pump head. The unique shape of the roller 220 allows the tube to be urged toward a center of the roller by side edges thereof.

In some embodiments, the compression roller 222 can be configured to compress or pinch the tube 240 against an interior surface of the pump head 202 as the roller 222 rotates within the pump head 202. The compression or pinching of the tube 240 occurs along a length of the tube as the compression roller 222 rotates. The movement and compression urges material disposed within the tube 240 to move through the tube 240 in the direction of rotation of the roller 222. Thus, the compression roller 222 can serve to urge fluid or other material through the tube 240 in the direction of the roller's rotation. In use, an industrial peristaltic pump may operate such that the ends of the tube are subjected to at high pressures. Additionally, such pumps can also be employed in pumping harmful chemicals.

During use, an industrial peristaltic pump may operate at high pressures while pumping harmful chemicals. In prior art peristaltic pumps, the rotor moves at about 125 rpm (if turned "on") or not at all (if turned "off"). However, in order to replace the tubing assembly, one must thread the tubing under the rollers of the rotor. Typically, this is attempted in the "off" mode, when the rotor is not moving at all, and the threading of the tubing is extremely difficult. In an embodiment, it is contemplated that although tubing replacement is easier if the rotor is moving in the "on" mode, serious injury can occur with the rotor moving at about 125 rpm.

Accordingly, in an embodiment, as shown in FIG. 2, the peristaltic pump 100 can comprise a safety switch mechanism 250 that causes the peristaltic pump 100 to slow down during use for a given reason. For example, the mechanism 250 can be configured such that removal of the head cover 208 can cause the peristaltic pump 100 to slow down for maintenance purposes. Thus, an operator may be able to remove the head cover 208 and thread the tubing 206 under slower-moving rollers of the rotor 204 without the danger of a fast-moving rotor.

More specifically, the peristaltic pump can comprise a maintenance mode that is triggered when the head cover 208 is removed. The head cover 208 can comprise a first sensor component 252 that is disposed adjacent to the pump 100 when the head cover 208 is properly fitted onto the pump 100. Further, the first sensor component 252 can be disposed away from the pump 100 when the head cover 208 is removed from the pump 100. The pump 100 can also comprise a second sensor component 254 that is operative to detect whether the first sensor component 252 is disposed adjacent to the pump 100. Further, the second sensor component 254 can be in electrical communication with the pump 100 in order to affect an operational or functional characteristic of the pump 100. In some embodiments, the second sensor component 254 can trigger a reduction in the rotational speed of the rotor 204.

For example, the head cover 208 and the first sensor component 252 can be configured to comprise a magnet and when the head cover 208 is removed, the sensor 254 can detect the absence of the magnet and can trigger the maintenance mode, or slowdown of the rotor 204. However, it is contemplated that other sensor devices can be used other than magnetic-based sensors. For example, it is contemplated that other sensors such as infrared sensors and the like. Once absence of the head cover 208 is detected, the rotor 204 of the peristaltic pump can slow from 125 rpm to 6 rpm. It is contemplated that the sensor 254 can be used to trigger other changes in the operation of the pump 100, such as stopping operation of the pump 100 or simply reducing the rotational speed of the rotor 204.

In addition, as shown in FIG. 2, some embodiments of the pump 100 can be configured such that the head cover 208 of the peristaltic pump 100 comprises an axle support portion 230. The axle support portion 230 can be configured to provide support for an end of an axle 260 (shown in FIG. 1) of the rotor 204. As such, an axle 260 can be disposed through the pump head 208, pass through a core or central portion 262 of the rotor 204, and be supported by the axle support portion 230 of the head cover 208. In such an embodiment, when the head cover 208 is mounted on the pump head 202, it can support an end of the rotor axle 260 which contributes to the longevity and durability of the peristaltic pump 100.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A peristaltic pump comprising:

a pump body comprising a pump head and a head cover extending across an opening in the pump head, the head cover having an open position and a closed position;

a rotor disposed within the pump head;

a sensor disposed on the pump head, the sensor being operative to detect whether the head cover is in the open or closed position; and a safety switch configured to control operation of the rotor such that when the pump is powered-on and the sensor detects that the head cover is in the open position, the safety switch causes the rotor to rotate at a reduced rpm in a maintenance mode that is slower than an operation speed and permits the pump to operate only at the reduced rpm when the sensor detects that the head cover is in the open position.

2. The pump of claim 1, wherein the sensor is attached to the head cover of the pump.

3. The pump of claim 2, wherein the sensor is aligned with a detection component attached to the pump head when the head cover is in the closed position.

4. The pump of claim 1, further comprising a controller which sets a rotational speed of the rotor in response to the position of the head cover.

5. The pump of claim 1, wherein the head cover is removed from the pump in the open position.

6. The pump of claim 1, wherein the safety switch is configured to permit the rotor to rotate at a rotational speed of between approximately 10 and 20 rpm in the maintenance mode.

7. The pump of claim 1, the safety switch is configured to permit the rotor to rotate at a rotational speed of between approximately 3 and 10 rpm in the maintenance mode.

8. The pump of claim 1, wherein when the pump is powered-on, the pump operates in a normal mode when the head cover is in the closed position.

9. The pump of claim 1, wherein the sensor is a magnet.

10. The pump of claim 1, wherein the sensor is a magnet disposed on the head cover.

11. A peristaltic pump for facilitating safe maintenance of the pump, the pump comprising:

a pump body comprising a pump head and a head cover extending across an opening in the pump head, the head cover having an open position in which the head cover is removed and a closed position in which the head cover is mounted onto the pump head; and a safety switch mechanism for detecting whether the head cover is in the open or closed position, the safety switch mechanism comprising a first sensor component and a second sensor component, the first sensor component being disposed on the head cover, the second sensor component being disposed on the pump head, the second sensor component being operative to detect the presence of the first sensor component when the head cover is in the closed position and to detect the absence of the first sensor when the head cover is in the open position, the safety switch being configured such that when the pump is powered-on and the head cover is in the open position, the safety switch causes a rotor of the pump to rotate at a reduced rpm in a maintenance mode that is slower than an operation speed and permits the pump to operate only at the reduced rpm when the head cover is in the open position.

12. The pump of claim 11, wherein the first sensor component is a magnet.

13. The pump of claim 11, wherein the first sensor component is a magnet disposed on the head cover.

14. The pump of claim 11, wherein the first sensor component is aligned with the second sensor component when the head cover is in the closed position.

15. The pump of claim 11, wherein the safety switch is configured to permit the rotor to rotate at a reduced rpm of less than 20 rpm in the maintenance mode.

16. The pump of claim 11, wherein the safety switch is configured to permit the rotor to rotate at a reduced rpm of between about 3 and 10 rpm in the maintenance mode.

17. The pump of claim 11, wherein the safety switch is configured to permit the rotor to rotate at a reduced rpm of between about 2 and 6 rpm in the maintenance mode.

18. A peristaltic pump for facilitating safe maintenance of the pump, the pump comprising:

a pump head and an opening in the pump head;

a rotor disposed in the opening of the pump head;

a head cover being mountable onto the pump head to extend across the opening in the pump head to cover the rotor; and a safety switch configured to control operation of the rotor such that when the pump is powered-on, the safety switch permits the rotor to rotate at an operational speed when the head cover is on the pump head and causes the rotor to rotate only at a reduced rpm that is slower than the operational speed when the head cover is off the pump head.

19. The pump of claim 18, wherein the safety switch mechanism comprises a first sensor component and a second sensor component, the first sensor component being disposed on the head cover, the second sensor component being disposed on the pump head, the second sensor component being operative to detect the presence of the first sensor component when the head cover is in the closed position and to detect the absence of the first sensor when the head cover is in the open position.

20. The pump of claim 19, wherein at least one of the first and second sensor components is magnetic.

21. The pump of claim 18, wherein the safety switch is configured to permit the rotor to rotate at a reduced rpm of less than 20 rpm when the head cover is off the pump head.

* * * * *